United States Patent [19]

Gillich et al.

[11] 4,381,226

[45] Apr. 26, 1983

[54] ELECTROCHEMICAL TREATMENT OF ALUMINUM IN NON-AQUEOUS POLYMERIC POLYBASIC ORGANIC ACID CONTAINING ELECTROLYTES

[75] Inventors: Thomas N. Gillich, Readington Township, Hunterdon County; John E. Walls, Annandale, both of N.J.

[73] Assignee: American Hoechst Corporation, Somerville, N.J.

[21] Appl. No.: 333,585

[22] Filed: Dec. 23, 1981

[51] Int. Cl.[3] ..... C25D 9/02; C25D 9/06

[52] U.S. Cl. ..... 204/14 N; 204/38 A; 101/456; 101/458; 101/459

[58] Field of Search ..... 204/38 A, 14 N; 101/456, 458, 459

[56] References Cited

U.S. PATENT DOCUMENTS 3,136,636 6/1964 Dowdall et al. .
3,181,461 5/1965 Fromson .
3,463,714 8/1969 Suomi et al. .
3,558,446 1/1971 Blake et al. .
3,676,382 7/1972 Scala et al. .
3,697,398 10/1972 Wessling et al. .
3,790,450 2/1974 Bloch et al. .
3,900,370 8/1975 Germscheid et al. .
3,943,065 3/1976 Phillips ..... 204/181
4,022,670 5/1977 Dean .
4,053,444 10/1977 Phillips ..... 260/30.2
4,153,461 5/1979 Berghaüser et al. ..... 101/456
4,180,442 12/1979 Byrd .

*Primary Examiner*—R. L. Andrews
*Attorney, Agent, or Firm*—Richard S. Roberts

[57] ABSTRACT

The invention is directed to the electrochemical treatment of aluminum substrates in a non-aqueous solution of a polymeric polybasic organic acid to provide a surface complex which promotes the adhesion of subsequently applied coatings to said surface.

11 Claims, No Drawings

ELECTROCHEMICAL TREATMENT OF ALUMINUM IN NON-AQUEOUS POLYMERIC POLYBASIC ORGANIC ACID CONTAINING ELECTROLYTES

BACKGROUND OF THE INVENTION

The present invention relates to the electrochemical treatment of aluminum surfaces. More particularly, the invention relates to treatments for an aluminum substrate to provide it with a surface which has improved adhesion to subsequently applied coatings which are useful for photographic elements in lithography. Such surfaces are also useful for capacitors, dielectric applications and other applications where a barrier layer is useful.

The use of aqueous electrolytes to produce an anodized aluminum surface for lithographic printing has been known for many years, and many methods of manufacture are known to those skilled in the art.

Although phosphoric acid anodized layers have many desirable features for lithographic use, it is well known that the anodized film is of a rather soft nature and of relatively poor abrasion resistance. This is a disadvantage when long run printing performance is required. Sulphuric acid anodized layers are much harder, have much greater abrasion resistance and therefore provide more robust lithographic printing plates capable of very long printing runs. They have consequently enjoyed and continue to enjoy considerable commercial success. The sulphuric acid process is also more easily adapted to producing thicker anodized layers than the phosphoric acid process, the latter tending to be self limiting owing to the greater solubility of the anodized film in the electrolyte. However, the sulphuric acid process produces layers which are not entirely satisfactory as lithographic substrates, since their receptivity towards ink and water tends to be non-discriminatory and methods of overcoming ink receptivity in the non-printing areas for example have to be used for all, but the thinnest of layers. This necessity for "desensitizing" the anodized layer can produce a serious problem, for example when it is required to manufacture pre-sensitized lithographic plates in which the adhesion of the light sensitive coating to the substrate during and after development is all important. When such densensitizing treatments are made to the anodized layer (for example by "sealing" or by "snubbing") the attainment of satisfactory ink-repellency in the non-printing areas, and at the same time satisfactory performance in the ink-receptive image areas, is a matter of well judged compromise. Such treatments can give lithographically desirable results and are in fact well known and in commercial use for both phosphoric acid and sulphuric acid anodized aluminum lithographic printing plates.

Examples of aluminum anodization in aqueous acidic electrolytes may be found in U.S. Pat. Nos. 3,900,370; 3,558,446 and 3,181,461. Aluminum treatments employing polyacids are taught in U.S. Pat. Nos. 4,153,461; 3,136,636 and 4,022,670. However, each disclosure employs aqueous treatment solutions which are conducive to oxide formation on the aluminum surface. The present invention in contradistinction employs non-aqueous electrolytes to form a thin, substantially non-porous organometallic complex on the aluminum surface and no substantial oxide formation. This surface complex demonstrates advantageous adhesive properties to subsequently applied coatings which are useful in the lithographic arts.

SUMMARY OF THE INVENTION

The present invention provides a process for treating a metal, preferably an aluminum sheet substrate which comprises electrolyzing said substrate in a non-aqueous solvent bath comprising a compatible polymeric polybasic organic acid wherein the solvent has a dipole moment of at least 1.5.

The process relates to the electrolytic formation of an organometallic layer by using aluminum as the anode and any inert metal or graphite as the cathode. DC voltage is then applied to the previously degreased and etched substrate through a non-aqueous solution. This solution contains a polymeric polybasic organic acid, which is dissolved in a solvent or solvents having the proper dipole moment so as to permit current flow while at the same time not entering into any reactions at either the cathode or anode.

Restricting the medium to a non-aqueous solution precludes the formation of oxides of the aluminum and thereby only permits the formation of the organometallic complex. Such a layer is highly non-porous and very thin. A very good interface is then provided which promotes better adhesion of applied coatings to the aluminum base than conventional anodized surfaces.

Upon following the procedure of the present invention, one notices a firm electrochemical bonding of the electrolyte to the aluminum surface. In contradistinction, other processes, including thermal processes where the metal sheet is dipped in a warm (e.g. 150° F.) bath of the same solution, only a relatively weak physical surface adhesion rather than a chemical bonding is obtained.

DETAILED DESCRIPTION OF THE PREFERRED EMBODIMENT

As hereinbefore mentioned, the invention provides a process for treating a metal sheet substrate, preferably comprising aluminum, which comprises direct or pulsed current electrolyzing the substrate in a non-aqueous solution containing a compatible polymeric polybasic organic acid and a compatible solvent having a dipole moment of at least 1.5.

The aluminum sheets which may be employed in the practice of this invention, include those which are made from aluminum and aluminum alloys including such alloys as Aluminum Association alloys 1100 and 3003. The thickness of the aluminum sheets which may be employed in the practice of this invention may be such as are usually and well known to be employable for such purposes, for example those which are from 0.004 inches to 0.025 inches in thickness; however, the exact choice of aluminum sheet may be left to the discretion of the skilled worker.

In the practice of the instant invention an aluminum sheet or web is first cleansed of its rolling grease by treatment with a suitable degreasing agent, such as by dipping in a bath containing 1,1,1 trichloroethane, trichoroethylene, methylene chloride, or perchlorethylene maintained at a temperature in excess of 165° F. for at least 10 seconds or an aqueous alkaline solution. It may then optionally be chemically, electrochemically or mechanically grained or etched, for example by rubbing the surface with a wire brush or forcing an aqueous slurry of pumice or silica over the surface, or dipping in a 1.0 N potassium or sodium hydroxide bath at room temperature for 30 seconds. The surface is then rinsed with deionized water and flushed with the solvent to be used in the electrolyzing bath. This is done to carefully avoid the introduction of any water into the electrolyzing bath. The substrate is then electrolyzed according to the teaching of the present invention.

The sheet is electrolyzed by employing the aluminum as an anode and passing it through a non-aqueous solvent bath containing a polymeric polybasic acid. Direct or pulsed current is applied under electrolyzing conditions employing any inert metal or graphite as the cathode. Suitable inert metals include lead and stainless steel, preferably alloy 316 or higher stainless steel.

Polymeric polybasic organic acids useful for the present invention include: sulfonic acids, phosphonic acids, phosphoric acids, and carboxylic acids which are preferably at least tribasic, and mixtures of the above. Specific electrolytes include the condensation product of benzene phosphonic acid and formaldehyde, (polybenzene phosphonic acid) co-polymers of methylvinyl ether and maleic anhydride at various molecular weights, copolymer of methylvinyl ether and maleic acid, polyvinyl sulfonic acid, polystyrene sulfonic acid, poly-n-butyl benzene sulfonic acid, poly diisopropyl benzene sulfonic acid, polyvinyl phosphonic acid, diisopropyl polynaththalene disulfonic acid, polydecyl benzene sulfonic acid, polyacrylic acid, polymethacrylic acid, polynaphthalene sulfonic acid, and mixtures of any of the foregoing.

The most preferred polybasic acids include polyvinyl phosphonic acid, and a copolymer of methylvinyl ether and maleic anhydride.

Solvents useful for this invention are those having a dipole moment of at least 1.5 and preferably in excess of 1.7.

Suitable non-aqueous solvents useful for the present invention include formamide, dimethyl sulfoxide, aniline, dimethyl formamide, mono-,di-,tri-ethanol amine, and tetrahydrofuran.

The acid may be present in the non-aqueous solution in an amount of from about 0.01% by weight to about saturation, more preferably from about 0.8% to about 5%. Naturally, the skilled artisan can determine the optimum concentration for his intended purpose.

The electrolytic temperature is preferably maintained at from about −5° C. to about 60° C., more preferably from about 10° C. to about 40° C., most preferably from about 20° C. to about 30°.

The preferred voltage preferably ranges from about 5 to about 120 volts, more preferably 10 to 60 volts and most preferably 20 to 40 volts.

Electrolyzing time is to be sufficient to apply a charge to the substrate of from about 1 to about 150 coulombs per square decimeter, more preferably 30 to 90 and most preferably 40–70 coulombs/dm$^2$.

The cathode to anode distance is preferably from about 1 to about 25 centimeters, more preferably from about 3 to about 15 cm. and most preferably from about 8 to about 10 cm.

Upon examining the resultant aluminum surface under a scanning election microscope at a 30,000 times magnification, a substantially non-porous surface is noticed. The surface demonstrates substantially no oxide formation and exhibits excellent adhesion to subsequently applied coatings which are suitable for lithographic purposes.

In the production of lithographic printing plates, the thusly formed substrate is first optionally hydrophilized such as by the application of a hydrophilizing composition. Such compositions employable in the practice of this invention include solutions of polyvinyl phosphonic acid, alkali metal silicate, such as sodium silicate, silicic acid, the Group IV-B metal fluorides, polyacrylic acid, the alkali zirconium fluorides, such as potassium zironcium hexafluoride, or hydrofluozirconic acid which are applied in concentrations of 0.5 to 20% by volume.

The sheet is then coated with a lithographically suitable photosensitive composition such as diazonium salts, quinone diazides and photopolymerizable compounds in admixture with suitable binding resins and other ingredients as are well known in the art. The photosensitized sheet is then exposed to ultraviolet radiation through a photomask, developed, and run on a printing press to produce a plurality of reproductions.

The invention may be illustrated by the following examples:

EXAMPLE 1

A section of grade 3003 mill finished aluminum was activated by etching in a 1.0 N solution of sodium hydroxide for thirty seconds at room temperature. The etched plate was then well rinsed with deionized water and immediately rinsed, without drying, with dimethyl sulfoxide (DMSO). When the surface is fully rinsed so that the remaining liquid is only DMSO, it is immersed in a bath consisting of 10 g/l of polyvinyl methyl ether/maleic acid copolymer dissolved in dimethyl sulfoxide. Already immersed in the bath at a distance of 2.0 inches from the aluminum, and being of approximately the same size, is a lead electrode. Where the aluminum workpiece is made the anode and the lead electrode is made the cathode, a rectified A.C. potential of 30 volts is applied for sixty seconds. An initial surge of current is observed which immediately begins to drop and eventually reaches a zero current flow. The treated aluminum section is well rinsed and blotted dry.

Using standard stripping techniques, the film thusly produced on the aluminum was removed and found to be present at a level of 88 mg/m$^2$. A similarly produced plate was inked in both a wet and dry fashion and found to be extremely hydrophilic by virtue of easy and total removal of all ink using light rinsing. Another section was spin-coated with a negative working light sensitive coating that is described in U.S. Pat. No. 3,867,147. A test negative was used with the proper exposure to result in a solid 6 on a twenty-one step Stauffer Density Guide (0.15 density per step). The exposed plate was then developed and functionally tested. The plate, upon roll-up, gave a very clean background which was easily maintained. Relative to a control plate that was made hydrophilic by thermally treating aluminum, that was likewise etched, and then treated with a 0.5% solution (dimethyl sulfoxide) of polyvinyl methyl ether/maleic anhydride copolymer at 160° F. for 60 seconds, the electrically processed plate performed 25% better on run length.

As a measure of porosity, or lack of porosity, a saturated solution of stannous chloride required 93 seconds to penetrate the electrolytically created layer to react with the aluminum as compared to 7 seconds for the thermally prepared plate. Further, U.S. Pat. No. 3,940,321, describes the use of a "zincate" test. With this method, the electrically prepared plate required 143 seconds to show a reaction while the thermally treated plate gave a response in 12 seconds.

EXAMPLE #2

A section of 1100 aluminum alloy was wet grained mechanically employing known techniques after which it was activated in a 1.0 N NaOH solution for 30 seconds. The etched plate was well rinsed with deionized water and then immediately well rinsed with formamide. The solvent covered plate was placed in a bath consisting of 15 g/l of polyvinyl phosphonic acid dissolved in formamide. In the bath at a distance of 5 centimeters was a lead electrode which was made the cathode. The aluminum was made the anode and had a potential of 20 volts using rectified alternating current for a time of 60 seconds. The treated plate was well rinsed and blotted dry. After removing the film, it was found to be present at a level of 90 mg/m$^2$. On a similarly produced sheet, both wet and dry ink testing indicated a very hydrophilic surface. The stannous chloride reaction time was 127 seconds and the "zincate" reaction time was 187 seconds. When compared to a thermally prepared control plate, using the same processing parameters given in Example #1 on a mechanically grained plate, the electrical processed plate performed better functionally by 32%.

EXAMPLE #3

The polymer given in Example #2, polyvinyl phosphonic acid, was added to propylene carbonate to the extent of 15 g/l. The polymer was totally insoluble and therefore could not give a usable system.

EXAMPLE #4

A section of 1050 alloy was electrochemically roughened using known techniques after which the section was rinsed and activated in a 1.0 N NaOH solution for 30 seconds and then well rinsed with deionized water. The aluminum section was immediately rinsed with dimethyl sulfoxide. The revised plate was then immersed in a bath consisting of 15 g/l of polystyrene sulfonic acid in dimethyl sulfoxide. In the bath was a lead electrode at a distance of 2.0 inches from the aluminum. With the lead being made the cathode and the aluminum being the anode, a potential of 60 volts using rectified alternating current was applied for 60 seconds. The treated plate was rinsed and blotted dry. Dry inking, wet inking and the coated plate were lithographically unacceptable because the surface was not sufficiently hydrophilic. However, the stannous chloride solution required >200 seconds to react with the aluminum and the "zincate" solution required >300 seconds to react. (After stripping, a film was measured to be 145 mg/M$^2$). Further the layer was electrically non-conductive giving it the characteristic of a dielectric. The non-porosity gives the advantage of a non oxiding surface.

EXAMPLE #5

A plate was prepared in like manner as described in Example #2 except that polyvinyl pyrrolidone was substituted for the polyvinyl phosphonic acid. Although readily soluble, no reaction occured with the aluminum as a result of not having any functional groups when the electrical potential was applied.

What is claimed is:

1. A process for treating an aluminum containing sheet substrate which comprises electrolyzing said substrate as an anode in a non-aqueous electrolyte comprising a solvent having a dipole moment of at least 1.5 and a compatible polymeric polybasic organic acid, wherein said electrolysis is conducted at a voltage of from about 5 to about 120 volts, with a charge application of from about 1 to about 150 coulombs per square decimeter of substrate, in an electrolyte maintained at a temperature of from about −5° to about 60° C., with a cathode to anode distance of from about 1 to about 25 centimeters.

2. The process of claim 1 wherein said acid comprises one or more acids selected from the group consisting of polymeric, polybasic organic sulfonic, phosphonic, phosphoric and carboxylic acids.

3. The process of claim 1 wherein said acid comprises one or more acids selected from the group consisting of the condensation product of benzene phosphonic acid and formaldehyde, co-polymers of methylvinyl ether and maleic anhydride, copolymer of methylvinyl ether and maleic acid, polyvinyl sulfonic acid, polystyrene sulfonic acid, poly-n-butyl benzene sulfonic acid, poly diisopropyl benzene sulfonic acid, polyvinyl phosphonic acid, diisopropyl polynaththalene disulfonic acid, polydecyl benzene sulfonic acid, polyacrylic acid, polymethacrylic acid, and polynaphthalene sulfonic acid.

4. The process of claim 1 wherein said solvent comprises one or more compounds selected from the group consisting of formamide, dimethyl sulfoxide, aniline, dimethyl formamide, mono-, di-, and tri-ethanol amine, and tetrahydrofuran.

5. The process of claim 1 wherein said acid comprises one or more compounds selected from the group consisting of polyvinyl phosphonic acid, and a copolymer of methylvinyl ether and maleic anhydride.

6. The process of claim 1 wherein the concentration of the acid in the electrolyte ranges from about 0.1% by weight to the saturation point.

7. The sheet produced according to the method of claim 1, 4, 5, 6, 2 or 3.

8. A photographic element which comprises a light sensitive composition adhered to the substrate prepared according to the process of claim 1.

9. A photographic element which comprises a hydrophilizing composition adhered to the substrate prepared according to the process of claim 1 and a light sensitive composition adhered to said hydrophilizing composition.

10. The photographic element of claim 9 wherein said hydrophilizing composition comprises a compound selected from the group consisting of polyvinyl phosphonic acid, alkali metal silicate silicic acid, Group IV-B metal fluorides, polyacrylic acid, alkali zirconium fluorides and hydrofluozirconic acid.

11. The photographic element of claim 8, 9 or 10 wherein said light sensitive composition comprises a compound selected from the group consisting of diazonium salts, quinone diazides and photopolymerizable compounds.

* * * * *